US006116520A

United States Patent [19]

Lee

[11] Patent Number: 6,116,520

[45] Date of Patent: Sep. 12, 2000

[54] FIRE-FIGHTING NOZZLE HAVING FLASH

[75] Inventor: Jeong Kyu Lee, Seoul, Rep. of Korea

[73] Assignee: Shilla Fire Equipment Co., Ltd., Rep. of Korea

[21] Appl. No.: 09/199,977

[22] Filed: Nov. 25, 1998

[30] Foreign Application Priority Data

May 13, 1998 [KR] Rep. of Korea ..... 98-17137

[51] Int. Cl.[7] ..... B05B 15/00

[52] U.S. Cl. ..... 239/289; 239/525; 239/558; 169/47

[58] Field of Search ..... 239/289, 558, 239/456–460, 525, 530; 169/37, 46, 47

[56] References Cited

U.S. PATENT DOCUMENTS

| | | | |
|---|---|---|---|
| 2,629,516 | 2/1953 | Badham | 239/281 X |
| 2,678,847 | 5/1954 | Caird | 239/456 |
| 3,784,804 | 1/1974 | Sabatelli et al. | 239/289 X |
| 4,291,839 | 9/1981 | Brett | 239/289 |
| 5,598,972 | 2/1997 | Klein | 239/289 X |

*Primary Examiner*—Kevin Weldon
*Attorney, Agent, or Firm*—Christie, Parker & Hale, LLP

[57] ABSTRACT

Disclosed is a fire-fighting nozzle integrated with a lighting apparatus. The lighting apparatus is integrally set within the housing of the nozzle so as to illuminate a target area at the scene of a fire without failure, thus allowing a firefighter to precisely spray water to the target area. The lighting apparatus comprises a bulb housing holding a bulb therein. An interior housing is longitudinally set within the nozzle housing, with the bulb housing being fitted into the front end of the internal housing. A connector is fixed to the inside surface of the nozzle housing at one end thereof without closing the water passage of the nozzle housing. The above connector is also assembled with the rear end of the internal housing through a screw-type engagement so as to allow the internal housing to be longitudinally positioned along the central axis within the water passage of the nozzle housing. An electric cord passage is provided through the nozzle housing, the connector and the battery case, thus allowing an electric cord to pass through so as to electrically connect the bulb of the bulb housing to the battery of the battery case.

5 Claims, 3 Drawing Sheets

FIRE-FIGHTING NOZZLE HAVING FLASH

BACKGROUND OF THE INVENTION

1. Field of the Invention

The present invention relates to a fire hose nozzle that spray water to put out a fire at the scene of fire, more particularly a fire hose nozzle equipped with a lighting apparatus to illuminate the scene of fire in order to more accurately spray water to a target area.

2. Prior Art

The scene of fire is usually dark due to an electricity failure and smoke that fills a premise which result in difficulty in clearly seeing the sights of fire. As a result of difficulty in visibility, water sprayed from a fire hose nozzle dose not reach the target area. Up to now, most firemen use a helmet attached with a flashlight to illuminate the scene of fire. Since a helmet attached with a flashlight is separated from a fire hose nozzle and illuminates the scene from a head of fireman, often times the target area is not clearly lit. As a result, the fireman has difficulties in putting out the fire since he has to move his head around while operating the fire hose nozzle to illuminate the scene.

SUMMARY OF THE INVENTION

In light of above stated problem in the prior art, the object of the present invention is to provide a fire hose nozzle that comprises a lighting apparatus so that a target area would be well lit when water is sprayed.

In order to achieve above object, the fire hose nozzle attached with a lighting apparatus accordance with the present invention consists of a fire hose nozzle housing connected to the fire hose to spray water and a lighting apparatus placed in center of inside of the fire hose nozzle housing to lit the targeted place where water is being sprayed.

The fire hose nozzle housing consists a hose-coupling nut as a means to connect a fire hose and the fire hose nozzle housing. Water passage pipe extends from the fire hose connector to a head portion of opposite end of nozzle and the head of nozzle consists of a plurality of outlet holes in which water flows to outside.

The lighting apparatus attached to a connector placed at the center of inside of the fire hose nozzle housing comprises: a connector consist with a helical protrusion; a light bulb head placed in the inside of a helical protrusion of a connector, and comprises; a light bulb, a reflector and a contact terminal; and a cover fastened to a helical protrusion of a connector joins a light bulb head to said connector.

A battery connecting port consists with a battery terminal is mounted on the outer cover of the fire hose nozzle housing so that it can engage to a contact terminal and an electrical wire of a light bulb head, and a battery case which holds batteries for the power source is formed in a cylindrical shape and threadedly attached at the outside cover of the fire hose nozzle housing, and a switch with on/off function is formed at one side of the battery case.

A water gate lever is attached on to the side of the fire hose nozzle housing to open and shut the water gate and a handle is attached at the lower part of the fire hose housing. A grip is formed on one side of the battery case so that it could function as a handle and replace the existing handle.

A fire hose nozzle according to the present invention comprises a lighting apparatus which can illuminate the scene of fire such that the visibility will be enhanced when there are darkness and smoke while water is being sprayed. As a result, fire could be put out more quickly and conveniently.

BRIEF DESCRIPTION OF THE DRAWINGS

Preferred embodiment of the present invention will be better understood after reading of the following detailed description in conjunction with the drawings in which.

DETAILED DESCRIPTION OF THE PREFERRED EMBODIMENT

With reference to the drawings FIGS. 1 through 8, a fire hose nozzle attached with a lighting apparatus embodying the object and concepts of the present invention will be described.

Figure 1:
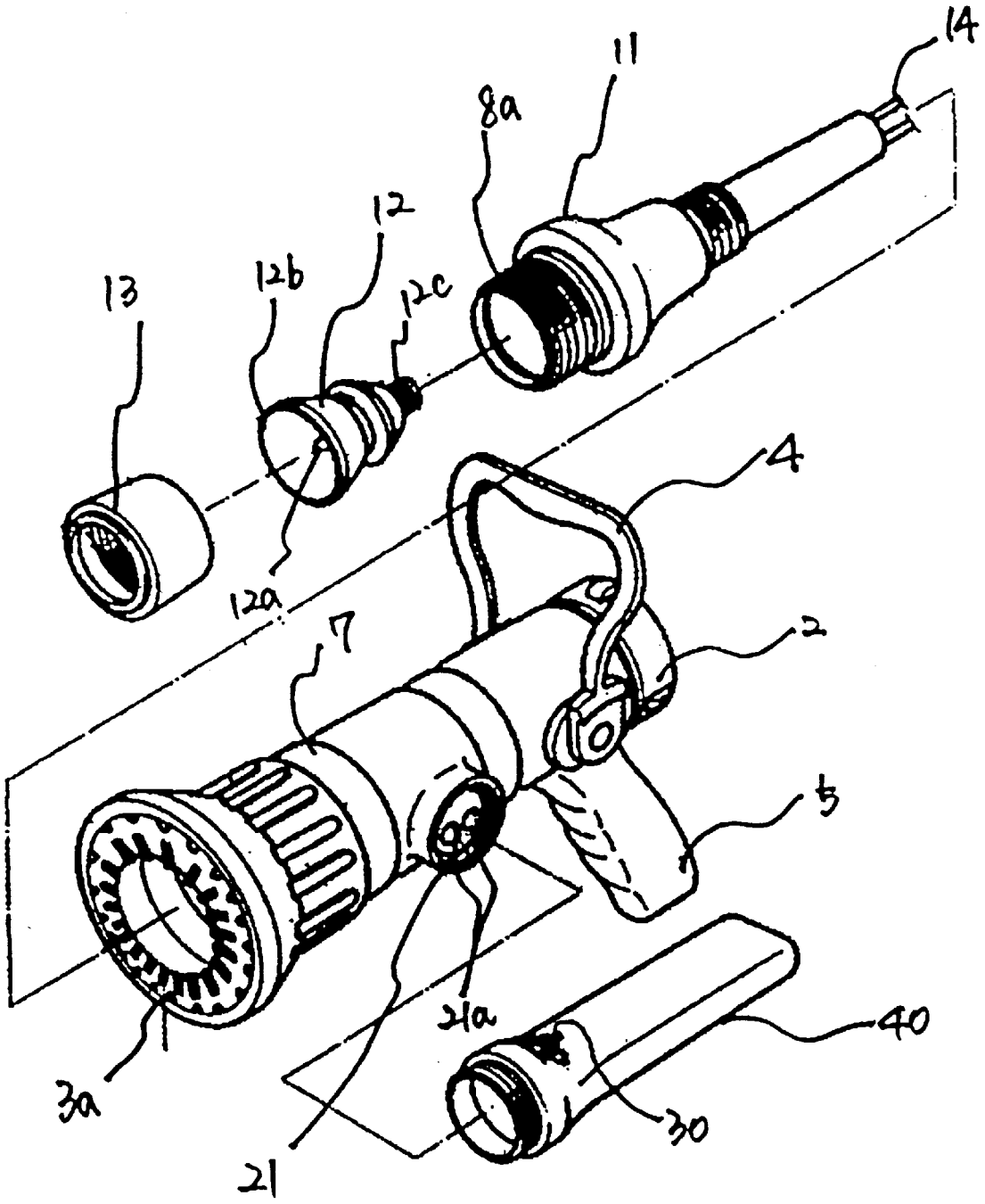
FIG. 1 is a perspective view of a fire hose nozzle according to the present invention.
Figure 2:
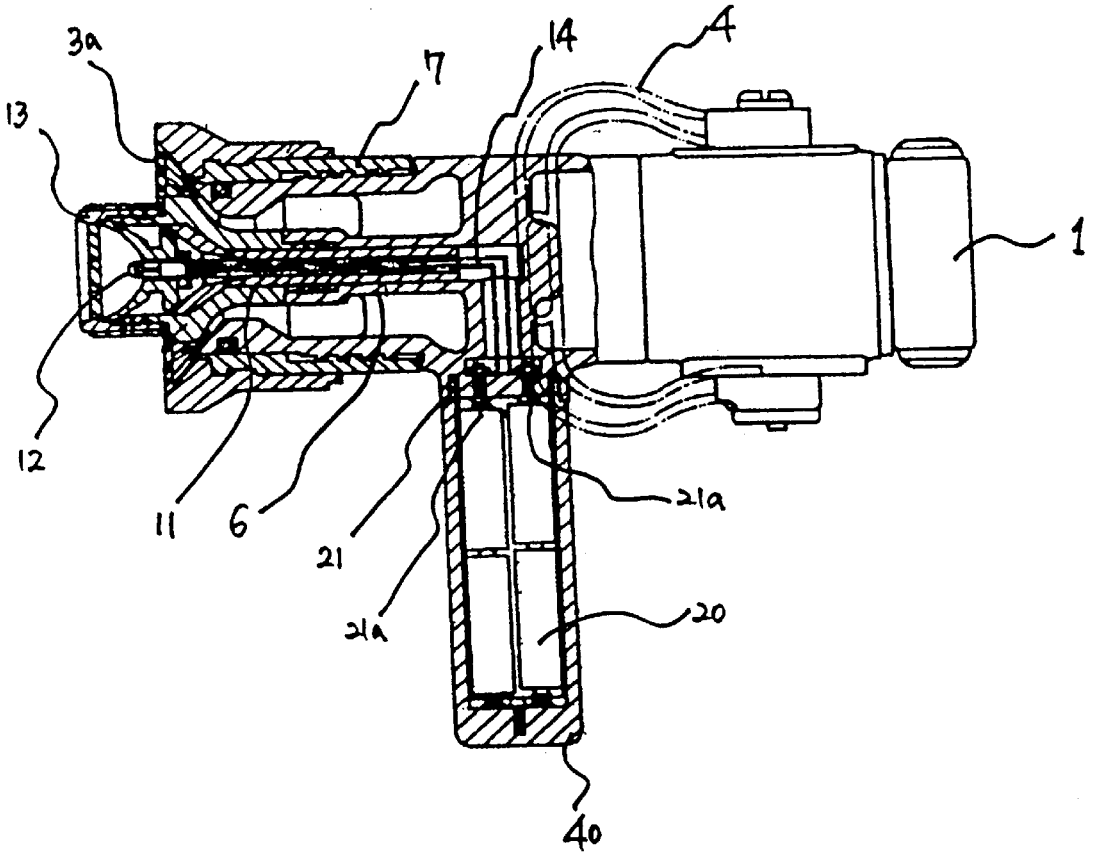
FIG. 2 is a cross-sectional view of the FIG. 1.

As illustrated in FIG. 1, the fire hose nozzle housing 1 is equipped with a hose coupling nut 2 which is used as a connecting means when engaging to a fire hose. A water valve 3 is placed in the inside of the fire hose housing 1 and a head of nozzle is formed with a plurality of outlet holes 3*a*. Water provided from the fire hose flows to the head of the nozzle and then discharged through the outlet holes 3*a*. A water gate lever 4 is attached on to the side of the fire hose housing in order to open and shut the water gate and a handle 5 is attached at the lower part of the fire hose nozzle housing 1.

The lighting apparatus 10 which is attached to a connector 6 placed at the center of inside of the fire hose nozzle housing 1 comprises a connector consists with a helical protrusion 8*a*, a light bulb head placed in the inside of a helical protrusion 8*a* of a connector 11 and a cover 13 which joins a light bulb head 12 to a connector 11. The connector 11 is comprised of an extension member 11*b* and the light bulb head 12 comprises a light bulb 12*a*, a reflector 12*b* and a contact terminal 12*c*. The cover 13 is fastened to the helical protrusion 8*a* of the connector 11. One end of an electrical wire 14 is attached to the contact terminal 12*c* of a light bulb head and the other end is attached to a battery contact terminal 21*c* of a battery connecting port 21 mounted on the outer cover of the fire hose nozzle housing 1.

A battery case 40, which holds batteries which are used as a power source, is formed in a cylindrical shape and threadedly attached at the outside cover of the fire hose nozzle housing 1. The battery case 40 is detachable to replace the batteries. When the batter case 40 is engaged onto the fire hose nozzle housing 1, batteries 20 then become connected to a battery contact terminal 21*c*. A switch 30 with on/off functions is formed at one side of the battery case 40 thereof and by using this switch a fireman can either turn on or off the light bulb 12*a*.

The control ring 7, which can be rotated, is placed at the outside cover of the fire hose nozzle housing 1. Rotation of the control ring 7 regulates the discharge pattern of water flowing through the outlet holes 3*a*. FIG. 3*a* illustrates when water is sprayed out in all directions and FIG. 3*b* illustrates a flow of water in one direction.

The fire hose nozzle according to the present invention can be attached to general fire hoses. To spray water, face the fire hose nozzle at the direction of a desired target area and operate the water gate lever 4. If visibility at the scene of fire is limited due to the darkness or smoke while spraying water, a fire man can then operate the switch 30 attached on the battery case 40 to turn on the light bulb to illuminate the scene. Since the lighting apparatus according to the present invention is placed within a fire hose nozzle, light will be flashed at the direction where water is being sprayed. Therefore, if the visibility increases by illuminating the scene of fire then water will be sprayed more accurately and fire will be put out more quickly and conveniently.

Moreover, the fire hose nozzle accordance with the present invention comprises battery case and a light bulb cover which can be easily attached and detached so that replacing a light bulb and batteries can be performed easily.

Figure 3:
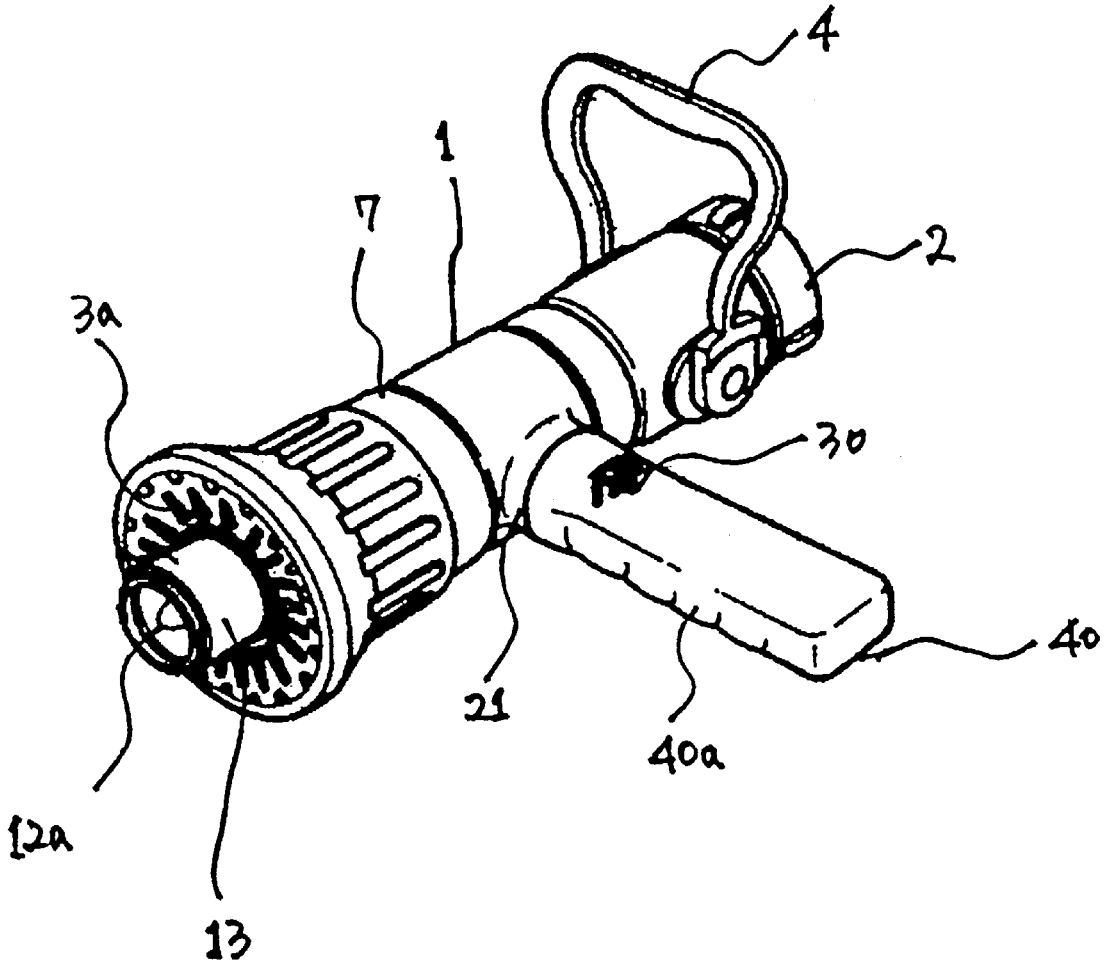
FIG. 3 is a perspective view showing alternative embodiment of fire hose nozzle attached with a lighting apparatus according to the present invention.

FIG. 3 illustrates other embodiment of the present invention in which basic configuration is same as the first embodiment. In this instance, a grip is formed on one side of the battery case 40 so that the battery case 40 can be utilized as a handle, and thus the handled 5 described in the first embodiment can be replaced. Other components and functions are same as that of first embodiment, therefore detailed explanation is omitted.

Although a preferred embodiment of the invention has been specifically illustrated and described herein, it is to be understood that minor changes may be made in the apparatus without departing from the spirit and scope of the invention as defined in the appended claims.

What is claimed is:

1. A fire-fighting nozzle comprising:

a cylindrical nozzle housing consisting of a coupling nut provided at a rear end of said nozzle housing for connecting the nozzle housing to a fire hose;

a longitudinal water passage formed in the nozzle housing so as to lead water from said fire hose to a front head of the nozzle housing;

a plurality of water outlet holes regularly formed on said front head of the nozzle housing and used for discharging water under pressure from the water passage to a desired target area in the area of a fire;

control valve means provided in a rear section within said nozzle housing and used for controlling said water passage, and a handle mounted to a lower part of the nozzle housing;

a battery case receiving at least one battery therein and removably attached to said nozzle housing through a screw-type engagement; and an on/off switch, and a lighting apparatus assembled with the nozzle housing and turned on or off by said on/off switch, wherein said lighting apparatus comprises:

a bulb housing holding a bulb therein;

an interior housing longitudinally set within the nozzle housing, with said bulb housing being fitted into a front end of said internal housing;

a connector fixed to an inside surface of said nozzle housing at one end thereof without closing the water passage of the nozzle housing, said connector being also assembled with a rear end of said internal housing through a screw-type engagement so as to allow the internal housing to be longitudinally positioned along a central axis within the water passage of the nozzle housing; and an electric cord passage formed through said nozzle housing, said connector and said battery case, thus allowing an electric cord to pass through so as to electrically connect the bulb of said bulb housing to the battery of said battery case, whereby said lighting apparatus emits light in the same direction as a water spraying direction of the water outlet holes of the nozzle housing.

2. The fire hose nozzle, as set forth in claim 1, wherein a water gate lever is attached on to the side of the fire hose nozzle housing to open and shut the water gate and a handle is attached at the lower part of the fire hose nozzle housing.

3. The fire hose nozzle, as set forth in claim 2, wherein the lighting apparatus attached to the connector placed at the inside center of the fire hose nozzle housing comprises:

the connector having a helical protrusion;

a light bulb head placed in the inside of said helical protrusion of the connector comprising a light bulb, a reflector and a contact terminal; and a cover fastened to a helical protrusion of the connector joining said light bulb head and said connector.

4. The fire hose nozzle, as set forth in claim 3, wherein a battery connecting port comprises a battery terminal mounted on the outer cover of the fire hose nozzle housing an electrically connector to said light bulb head, a battery case adapted to hold batteries to serve as a power source formed in a cylindrical shape and a switch with on/off function at one side of the battery case.

5. The fire hose nozzle, as set forth in claim 4, wherein a grip is formed on one side of the battery case so that said battery case can be used as a handle.

* * * * *